United States Patent [19]

Sigwald et al.

[11] 4,190,031

[45] Feb. 26, 1980

[54] DEVICES FOR RE-CYCLING THE EXHAUST GASES OF AN INTERNAL COMBUSTION ENGINE

[75] Inventors: Jacques Sigwald, Frepillon; Michel Achard, La Garenne Colombes, both of France

[73] Assignees: Automobiles Peugeot; Societe Anonyme Automobiles Citroen, both of Paris, France

[21] Appl. No.: 903,131

[22] Filed: May 5, 1978

[30] Foreign Application Priority Data

May 11, 1977 [FR] France ..... 77 14416

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 2,722,927 | 11/1955 | Cornelius | 123/119 A |
| 3,621,825 | 11/1971 | Ojala | 123/119 A |
| 3,738,342 | 6/1973 | Lewakowski | 123/119 A |
| 3,774,583 | 11/1973 | King | 123/119 A |
| 3,842,814 | 10/1974 | Bier | 123/119 A |
| 3,931,813 | 1/1976 | Horie et al. | 123/119 A |
| 4,080,941 | 3/1978 | Bertrand | 123/119 A |
| 4,124,006 | 11/1978 | Rodenkirch | 123/119 A |

*Primary Examiner*—Ronald H. Lazarus
*Assistant Examiner*—Magdalen Moy
*Attorney, Agent, or Firm*—Burns, Doane, Swecker & Mathis

[57] ABSTRACT

The device regulates the flow of exhaust gas reintroduced in the induction pipe in accordance with the conditions of utilization of the engine. It consists mainly in modifying a depression case the movable wall of which is connected by a cable to the closure member regulating the amount of gas re-cycled. This wall has an opening with which cooperates a valve subjected to the opposed actions of a spring which tends to apply it against its seat and a rod actuated by the butterfly valve member placed in the induction pipe. In this way there is provided a control which is independent of the characteristics of the various springs and is therefore more precise.

10 Claims, 5 Drawing Figures

DEVICES FOR RE-CYCLING THE EXHAUST GASES OF AN INTERNAL COMBUSTION ENGINE

The present invention is applicable to an internal combustion engine and relates to a device whereby it is possible to regulate the flow of exhaust gas reintroduced in the induction pipe in accordance with the conditions of utilization of the engine.

It is known that the agents of pollution emitted by the exhaust gases of internal combustion engines include nitrogen oxides and it is also known that in re-cycling a part of the exhaust gases so as to mix them with the fresh gases arriving in the induction pipe of the engine the temperature of the combustion in the combustion chambers is reduced, which has for effect to reduce the formation of the nitrogen oxides and consequently the emission of the nitrogen oxides in the exhaust gases.

It is moreover known that the optimum ratio between the amount of gas re-cycled and the amount of caburetted mixture admitted into the cylinders is obtained if the device regulating the amount of re-cycled gas is directly related to the position of the throttle means of the induction pipe. It is then possible to maintain a constant re-cycling rate irrespective of the speed of the engine throughout the range of utilization under partial load for which the re-cycling is necessary. Unfortunately, a direct control of the regulating device by the throttling means of the induction pipe leads to a stiffening of the accelerator pedal which renders the driving of the vehicle particularly tiring.

This is why there have been proposed regulating devices actuated by a depression case connected to a depression take-off located in the induction pipe, means being provided to ensure that the value of the depression applied in the case is directly related to the position of the throttling means of the induction pipe.

However, these devices employ a certain number of parts, in particular springs, the characteristics of which vary and do not permit a good constancy in the results under mass-production conditions.

A device is also disclosed in U.S. Pat. No. 3,738,342 for regulating the flow of re-cycled gases as a function of the position of the fuel throttle which has the following drawbacks:

It is difficult to position in the engine owing to its linear disposition and the presence of rigid connecting elements between the various components.

It is very sensitive to soiling since it comprises a servo-valve which has a body and a rod constituting a slide valve which undergoes sliding movements and this servo-valve is located in a particularly exposed region.

An object of the invention is to provide a regulating device which overcomes the various drawbacks of the known arrangements and is in particular more reliable and more easily positioned than the device disclosed in the aforementioned U.S. Patent.

According to the invention, there is provided a device for regulating the flow of exhaust gas re-cycled in the induction pipe of an internal combustion engine comprising a valve for regulating the flow of re-cycled gas interposed in the re-cycling circuit between an exhaust pipe and an induction pipe provided with throttling means, the closure means of said valve being actuated by the movable wall of a depression case which has a first chamber either connected to a depression takeoff located on the induction pipe or connected to the atmosphere under the control of regulating means controlled by the throttling means, and a second chamber connected to the atmosphere, wherein the movable wall of the depression case comprises a seat which defines an opening and is cooperative with a valve member subjected to the opposing actions of a rod mechanically connected to the throttling means of the induction pipe and a spring which biases the valve member against said seat and closes said opening.

Two embodiments will be described hereinafter with reference to the accompanying drawings in which.

Figure 1:
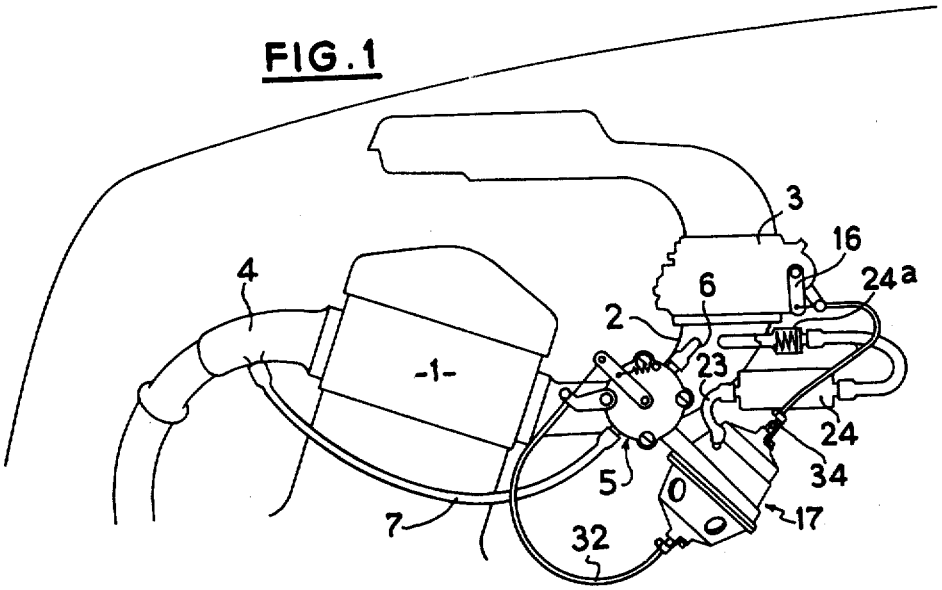
FIG. 1 is an assembly view showing the position of the device according to the invention in an internal combustion engine.

FIG. 1 shows an internal combustion engine 1 with its induction pipe 2, its carburetor 3 and its exhaust pipe 4.

A re-cycling valve 5 fixed to the induction pipe 2 communicates with the latter through a conduit 6 and with the exhaust pipe through a conduit 7. The valve 5 comprises a chamber 8 connected to the conduit 6 and a chamber 9 connected to the conduit 7, the two chambers being separated by a fixed wall 10 and a movable wall 11. The fixed wall 10 has an opening 12 and the movable wall 11 has an opening 13 which is capable of substantially coinciding with the opening 12.

The movable wall 11 is rigid with a shaft on an outer end portion of which there is mounted a lever 14. A spring 15 biases the lever 14, and therefore the movable wall 11, in the direction in which the opening 12 is completely closed.

The carburetor 3 comprises in the known manner a throttling means or butterfly valve member (not shown). The latter is rigid with an outer lever 16.

The position of the lever 14 of the valve 5 is controlled by the position of the lever 16 of the carburetor 3 through control means which comprise a depression case 17. The case 17 comprises two bellshaped members 18, 19 between which a flexible diaphragm or movable wall 20 is clamped, the diaphragm defining in the centre thereof a rigid partition wall 21. The member 18 defines with the diaphragm 20 and the partition wall 21 a depression chamber 22 which is connected to the induction pipe 2 by way of a conduit 23 in which there is interposed a reserve vacuum chamber 24 and a check-valve 24$^a$. A spring 25 biases the wall 21 in opposition to the depression prevailing in the chamber 22. The member 19 defines with the diaphragm 20 and the partition wall 21 a chamber 26 which permanently communicates with the atmosphere by way of openings 27.

The partition wall 21 has a seat 28 defining an opening 28$^a$ which is closed by a valve member 29 biased by a spring 30 which bears against a member 31 rigid with the partition wall 21. This member 31 is connected by a sheathed cable 32 to the lever 14 of the valve 5.

The member 18 has extending therethrough a sliding rod 33 which is connected by a sheathed cable 34 to the lever 16 of the fuel throttle and is capable of coming in contact by its other end with the valve 29.

A spring 35 biases the rod 33 toward the valve member 29 in opposition to the action of the return spring (not shown) of the fuel throttle which maintains the cable 34 taut. This spring 35 bears against a partition wall 35$^a$ which also defines a guide 35$^b$ for the rod 33.

The device just described operates in the following manner:

When the fuel throttle is opened, the lever 16 pulls on the cable 34 in the direction in which the rod 33 tends to move away from the valve member 29. The suction which prevails in the chamber 22 attracts the partition wall 21, equilibrium being reached when the edge of the opening 28 and the end of the rod 33 are substantially in the same plane.

Figure 2:
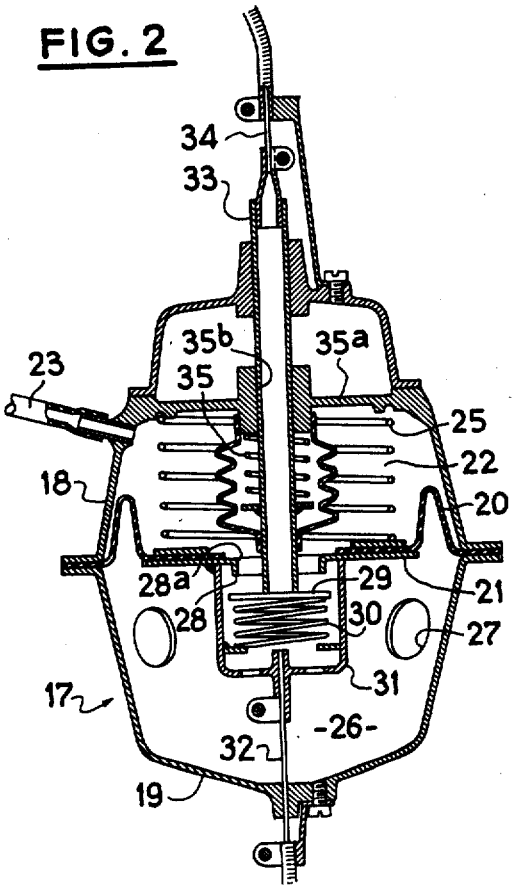
FIG. 2 is a sectional view of a first embodiment of the depression case.
Figure 3:
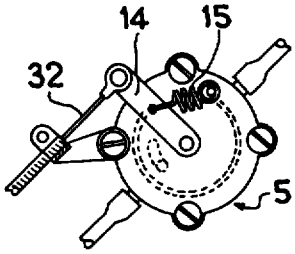
FIGS. 3 and 4 are respectively an elevational view and a sectional view of one type of the regulating valve.
Figure 4:
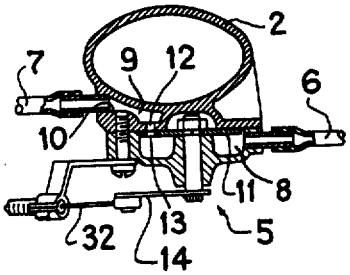

On the other hand, when the fuel throttle is closed, the spring 35 urges the rod 33 which tends to move the valve member 29 away from the opening 28 (position shown in FIG. 2). The chamber 22 is then put in communication with the atmosphere and the partition wall 21 is urged by the spring 25 until the opening 28 is once again closed, equilibrium being reached as before.

As the partition wall 21 is connected by the cable 32 to the lever of the valve 5, the position of the lever 14 depends on that of the lever 16 so that the free opening of the valve 5 is a function of the opening of the fuel throttle and this result is obtained independently of the characteristics of the springs employed, which corresponds perfectly to the object of the invention.

Figure 5:
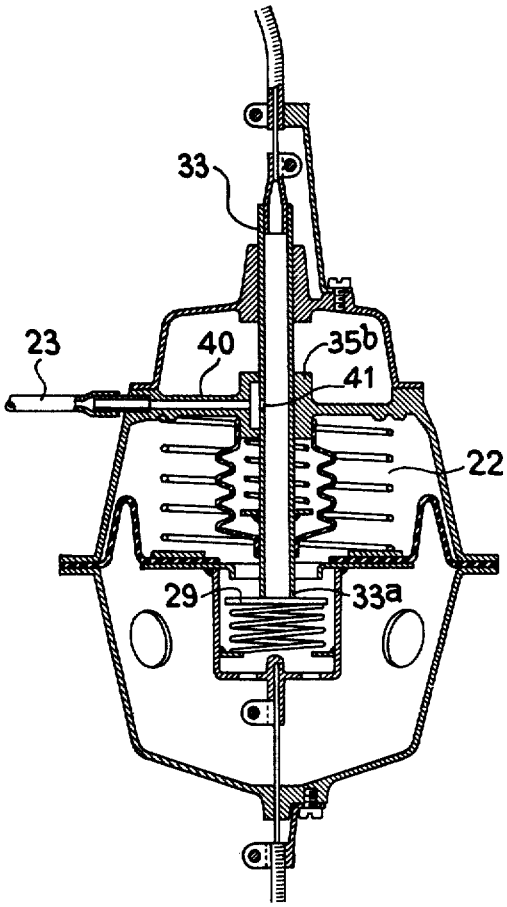
FIG. 5 is a view similar to FIG. 2 of a second embodiment of the depression case.

In the modification shown in FIG. 5, the depression conduit 23 does not open directly into the chamber 22. It is connected to a passageway 40 which communicates, by way of a recess formed in the guide 35$^b$ and an orifice 41, with the hollow interior of the rod 33. The latter is also open at the end 33$^a$ thereof adjacent the valve member.

This case operates in the same manner as the case shown in FIG. 2 apart from the following difference:

When the valve member 29 is shifted by the rod 33, it closes at the same time the central hollow of the rod 33 which closes off the source of depression which is not put in communication with the atmosphere. In this way, any risk of disturbance of the source of depression is avoided, which constitutes a further advantage.

In both embodiments, the device has a compact and integrated construction which satisfies the object of the invention, all of the parts except the cable being disposed within an enclosure defined by the two members 18 and 19.

Having now described our invention what we claim as new and desire to secure by Letters Patent is:

1. A device for regulating the flow of exhaust gas re-cycled in the induction pipe of an internal combustion engine, comprising an induction pipe of the engine, a depression take-off orifice in the induction pipe, throttling means in the induction pipe, an exhaust pipe of the engine, a re-cycling passageway interposed between and interconnecting the induction pipe and exhaust pipe, a valve for regulating the flow of re-cycled gas inserted in the re-cycling passageway between the exhaust pipe and the induction pipe, the regulating valve comprising a closure member for said passageway, and control means for controlling the regulating valve and comprising a depression case comprising a movable wall which is movable relative to the depression case, first connecting means connecting the movable wall to the closure member for shifting the closure member upon movement of the movable wall relative to the depression case, a first chamber and a second chamber defined within the case by the movable wall on opposite sides of the movable wall, the second chamber communicating with the atmosphere, the movable wall of the depression case comprising a seat which is movable with the movable wall relative to the depression case and defines an opening which puts the first chamber in communication with the second chamber, a valve member movably mounted in the depression case and cooperative with the seat for selectively opening and closing said opening, a rod movably mounted on the depression case, second connecting means connecting the rod to the throttling means to shift the rod by movement of the throttling means, and a spring which biases the valve member against said seat to close said opening, the rod being operative on the valve member to shift the valve member away from the seat, in opposition to the action of the spring, when the throttle is closed, and to allow the valve member to be shifted toward the seat by the action of the spring when the throttle is opened.

2. A device as claimed in claim 1, wherein said rod extends axially in the first chamber of the case and through the opening defined in the movable wall of the case.

3. A device as claimed in claim 1, wherein the throttling means comprises a return spring and the rod is provided with a return spring which opposes the action of the return spring of the throttling means.

4. A device as claimed in claim 1, wherein the second connecting means comprise a lever rigid with the throttling means, and a sheathed cable connecting the rod to the lever rigid with the throttling means.

5. A device as claimed in claim 1, wherein the first connecting means comprise a sheathed cable.

6. A device as claimed in claim 1, wherein the depression case comprises two main parts defining with the movable wall the two chambers, which chambers contain all the component parts of the control means except for the first connecting means and second connecting means.

7. A device for regulating the flow of exhaust gas re-cycled in the induction pipe of an internal combustion engine, comprising an induction pipe of the engine, a depression take-off orifice in the induction pipe, throttling means in the induction pipe, an exhaust pipe of the engine, a re-cycling passageway interposed between and interconnecting the induction pipe and exhaust pipe, a valve for regulating the flow of re-cycled gas inserted in the re-cycling passageway between the exhaust pipe and the induction pipe, the regulating valve comprising a closure member for said passageway, and control means for controlling the regulating valve and comprising a depression case comprising a movable wall which is movable relative to the depression case, first connecting means connecting the movable wall to the closure member for shifting the closure member upon movement of the movable wall relative to the depression case, a rigid member rigid with the movable wall, a first chamber and a second chamber defined within the case by the movable wall on opposite sides of the movable wall, the second chamber communicating with the atmosphere, the movable wall of the depression case comprising a seat which is movable with the movable wall relative to the depression case and defines an opening which puts the first chamber in communication with the second chamber, a valve member movably mounted in the depression case and cooperative with the seat for selectively opening and closing said opening, a rod movably mounted on the depression case, second connecting means connecting the rod to the throttling means to shift the rod by movement of the throttling means, and a spring which is interposed between the valve member and the rigid wall and biases the valve member against said seat to close said opening, the rod being operative on the valve member to shift the valve member away from the seat, in opposition to the action of the spring, when the throttle is closed, and to allow the valve member to be shifted toward the seat by the action of the spring when the throttle is opened.

8. A device as claimed in claim 7, wherein the rod is hollow and open at an end thereof facing the valve member and communicates with the depression take-off orifice.

9. A device for regulating the flow of exhaust gas re-cycled in the induction pipe of an internal combustion engine, comprising an induction pipe of the engine, a depression take-off orifice in the induction pipe, throttling means in the induction pipe, an exhaust pipe of the engine, a re-cycling passageway interposed between and interconnecting the induction pipe and exhaust pipe, a valve for regulating the flow of re-cycled gas inserted in the re-cycling passageway between the exhaust pipe and the induction pipe, the regulating valve comprising a closure member for said passageway, and control means for controlling the regulating valve and comprising a depression case comprising a movable wall which is movable relative to the depression case, first connecting means connecting the movable wall to the closure member for shifting the closure member upon movement of the movable wall relative to the depression case, a first chamber and a second chamber defined within the case by the movable wall on opposite sides of the movable wall, the second chamber communicating with the atmosphere, the movable wall of the depression case comprising a seat which is movable with the movable wall relative to the depression case and defines an opening which puts the first chamber in communication with the second chamber, a valve member movably mounted in the depression case and cooperative with the seat for selectively opening and closing said opening, a rod movably mounted on the depression case, second connecting means connecting the rod to the throttling means to shift the rod by movement of the throttling means, a spring which biases the valve member against said seat to close said opening, the rod being operative on the valve member to shift the valve member away from the seat, in opposition to the action of the spring, when the throttle is closed, and to allow the valve member to be shifted toward the seat by the action of the spring when the throttle is opened, a first return spring connected to the throttling means, a second return spring which is connected to the rod and opposes the action of the first return spring, a rigid wall of the case and means defining a bearing surface on said rod, the second return spring being disposed between the rigid wall of the case and the bearing surface.

10. A device for regulating the flow of exhaust gas re-cycled in the induction pipe of an internal combustion engine, comprising an induction pipe of the engine, a depression take-off orifice in the induction pipe, throttling means in the induction pipe, an exhaust pipe of the engine, a re-cycling passageway interposed between and interconnecting the induction pipe and exhaust pipe, a valve for regulating the flow of re-cycled gas inserted in the re-cycling passageway between the exhaust pipe and the induction pipe, the regulating valve comprising a closure member for said passageway, and control means for controlling the regulating valve and comprising a depression case comprising a movable wall which is movable relative to the depression case, first connecting means connecting the movable wall to the closure member for shifting the closure member upon movement of the movable wall relative to the depression case, a first chamber and a second chamber defined within the case by the movable wall on opposite sides of the movable wall, the second chamber communicating with the atmosphere, the movable wall of the depression case comprising a seat which is movable with the movable wall relative to the depression case and defines an opening which puts the first chamber in communication with the second chamber, a valve member movably mounted in the depression case and cooperative with the seat for selectively opening and closing said opening, a rod movably mounted on the depression case, second connecting means connecting the rod to the throttling means to shift the rod by movement of the throttling means, a spring which biases the valve member against said seat to close said opening, the rod being operative on the valve member to shift the valve member away from the seat, in opposition to the action of the spring, when the throttle is closed, and to allow the valve member to be shifted toward the seat by the action of the spring when the throttle is opened, a conduit, a guide for the rod, a recess in the guide and an orifice in the rod, the rod being hollow and the interior of the rod being connected to the source of depression by way of the conduit which communicates with the recess formed in the guide and the orifice which communicates with the recess.

* * * * *